US011497984B2

(12) United States Patent
Rengelis

(10) Patent No.: US 11,497,984 B2
(45) Date of Patent: Nov. 15, 2022

(54) AUTOMATED DICE TOSSING APPARATUS

(71) Applicant: Evolution Malta Limited, Sliema (MT)

(72) Inventor: Raivis Rengelis, Riga (LV)

(73) Assignee: Evolution Malta Limited, Sliema (MT)

( * ) Notice: Subject to any disclaimer, the term of this patent is extended or adjusted under 35 U.S.C. 154(b) by 102 days.

(21) Appl. No.: 17/165,582

(22) Filed: Feb. 2, 2021

(65) Prior Publication Data

US 2021/0236916 A1 Aug. 5, 2021

(30) Foreign Application Priority Data

Feb. 3, 2020 (EP) ..... 20155182

(51) Int. Cl.
*A63F 9/04* (2006.01)

(52) U.S. Cl.
CPC .... *A63F 9/0406* (2013.01); *A63F 2250/1036* (2013.01); *A63F 2250/38* (2013.01)

(58) Field of Classification Search
CPC ..... A63F 2250/1036; A63F 2250/38; A63F 2009/0408; A63F 9/0406
See application file for complete search history.

(56) References Cited

U.S. PATENT DOCUMENTS 1,054,694 A * 3/1913 Langworthy ..... A63F 9/0406 273/145 A
1,382,695 A * 6/1921 Van Vleet ..... A63F 3/00085 273/287
2,302,333 A * 11/1942 Linke ..... A63F 9/0406 273/138.2
2,791,432 A * 5/1957 Alvernaz ..... A63F 9/0406 366/279
3,566,537 A * 3/1971 Tepper ..... A63H 13/10 446/354
3,684,291 A * 8/1972 Johmann ..... A63H 13/04 273/145 A
3,831,948 A * 8/1974 Suda ..... A63F 9/0406 273/145 R
4,807,883 A * 2/1989 Silverman ..... A63F 9/0415 273/274

(Continued)

FOREIGN PATENT DOCUMENTS

DE 805377 C 5/1951

OTHER PUBLICATIONS

European Patent Office. Extended European Search Report for application 20155182.7, dated Aug. 13, 2020. 6 pages.

*Primary Examiner* — Michael D Dennis
(74) *Attorney, Agent, or Firm* — Quarles & Brady LLP

(57) ABSTRACT

The present disclosure relates to an automated dice tossing apparatus comprising; a main body portion; an elongated toss-arm, having a proximal portion rotatably attached to said main body portion about a pivot axis, a vessel mounted to a distal portion of said toss-arm for holding at least one die; a pneumatic actuator configured to, upon actuation, move the toss-arm about the pivot axis with an ejection force such that at least one die held in the vessel is tossed away from said vessel towards a predefined target area; and control circuitry configured to randomly determine a magnitude of the ejection force within a predefined range in order to randomize a set of initial conditions for each actuation of the pneumatic actuator.

14 Claims, 9 Drawing Sheets

(56) References Cited

U.S. PATENT DOCUMENTS

| | | | | |
|---|---|---|---|---|
| 5,980,399 | A * | 11/1999 | Campbell | A63B 69/409 124/72 |
| 10,518,159 | B1 * | 12/2019 | Rosencrans | A63B 69/0002 |
| 10,688,383 | B2 * | 6/2020 | Chun | A63F 9/0468 |
| 2008/0048394 | A1 * | 2/2008 | C. H. | A63F 9/0406 273/144 R |
| 2010/0044962 | A1 | 2/2010 | Ritter | |
| 2010/0133748 | A1 * | 6/2010 | Tseng | A63F 9/0406 273/145 C |
| 2016/0250536 | A1 * | 9/2016 | Hart | F41B 3/03 124/7 |
| 2017/0216717 | A1 * | 8/2017 | Koyanagi | A63F 9/0468 |

* cited by examiner

AUTOMATED DICE TOSSING APPARATUS

CROSS-REFERENCE TO RELATED APPLICATIONS

This application claims priority to European Patent Application No. EP 20155182.7 filed Feb. 3, 2020, the disclosure of which is incorporated herein by reference in its entirety and for all purposes.

TECHNICAL FIELD

The present disclosure relates to an automated dice tossing apparatus comprising a main body portion, an elongated toss-arm, a pneumatic cylinder and control circuitry and a method for operating the same.

BACKGROUND

Dice are known in the art to be incorporated in different settings to create randomized output. Randomness from a dice toss are generated from that the initial condition of a throw are amplified exponentially. The force the dice are tossed with and the direction the dice are tossed with all contribute to the outcome of a dice toss. Thus, the randomness from a dice toss by a human to a large extent is generated from that a human can't control the initial conditions.

However, it may be difficult for a dealer in a gaming setting to reiteratively toss dice. Further, a user that made a wager that depends on the dice toss of a dealer may not fully trust that the dealer tosses the dice in a randomized manner so to prevent the user from winning. Since the dice tossing is done manually, the dealer may influence the outcome of the dice toss to some extent. Therefore, the ability to influence the outcome of a dice toss in a manual dice tossing operation cannot be fully excluded.

Based on this, it is desirable to provide an automatic dice tossing apparatus that automatically tosses the dice to achieve a fully transparent dice tossing procedure. Automated dice shaking devices are known in the present art. The dice shaking devices known in the present art doesn't toss the dice to resemble how it is done manually by a human. Thus, to fully enhance user experience, a dice tossing apparatus that resembles a dice toss from a human is desired. However, an automated dice tossing apparatus that resembles the dice toss from a human would be required to throw the dice in a randomized manner to alleviate the problem of trust towards the thrower.

Hence, there is a need for an automated dice tossing apparatus that can resemble the dice toss of a human, but do it in a randomized manner so to be trusted by the users of the dice trusting apparatus.

US2010133748A discloses an automated dice shaking system that includes multiple dice seat holders each having two locating grooves, multiple dice seats selectively attachable to the dice seat holders, each dice seat having an inner thread and locating rods attachable to the locating grooves of one dice seat holder to prohibit rotation of the respective dice seat relative to the respective dice seat holder, a dice cup connectable to one dice seat by threading an outer thread thereof into the inner thread of one dice seat and movable with the connected dice seat away from the dice seat holders to shake the respective set of dice, and a mechanical arm controllable to move the dice cup horizontally and vertically and to rotate the device cup.

Thus, even though previous solutions work well in some situations, it would be desirable to provide an automated dice tossing apparatus that address requirements for an automated dice tossing apparatus.

SUMMARY

It is therefore an object of the present disclosure to provide an automated dice tossing apparatus to mitigate, alleviate or eliminate one or more of the above-identified deficiencies and disadvantages.

This object is achieved by means of an automated dice tossing apparatus as defined in the appended claims.

The present disclosure is at least partly based on the insight that by providing an automated dice tossing apparatus that randomizes the initial conditions of its toss and resembles a human dice toss, the user experience will be enhanced and dice tossing will be more efficient. In more detail, it was realized by the present inventor that the randomness of a human dice toss is to a large extent due to the fact that a human cannot re-produce the initial conditions a dice toss (angle of throw, position of throw, position of the die in the hand, throwing velocity, and so forth). Thus, in order to provide an automated dice tossing solution, one must ensure that the initial conditions are not the same for two independent throws. In accordance with the disclosure there is provided an automated dice tossing apparatus according to claim 1 and a method according to claim 13.

The present disclosure provides an automated dice tossing apparatus comprising; a main body portion; an elongated toss-arm having a proximal portion rotatably attached to said main body about a pivot axis. A vessel mounted to a distal portion of said toss-arm for holding at least one die. A pneumatic actuator configured to, upon actuation, move the toss-arm about the pivot axis with an ejection force such that at least one die held in the vessel is tossed away from said vessel towards a predefined target area; and control circuitry configured to randomly determine a magnitude of the ejection force within a predefined range in order to randomize a set of initial conditions for each actuation of the pneumatic actuator.

A benefit of the automated dice tossing apparatus is that the control circuitry is configured to randomly determine a magnitude of the ejection force, which results in that the dice are tossed away with different forces for each actuation of the pneumatic actuator. Thus, there is provided a fully randomized dice tossing procedure. The ejection force is within a predefined range that is adapted to allow at least one die to leave the vessel.

A further benefit of the automated dice tossing apparatus is that the apparatus tosses the dice in a manner that resembles the toss of a human. The automated dice tossing apparatus comprises an arm and a vessel which are moved about a pivot axis to toss the dice, which can be compared to the arm of a human rotating around the shoulder where the dice are tossed from their hand. By having the automated dice tossing apparatus in this manner, it provides in more trust from the users of the apparatus, and further, the toss is more transparent for a user since the dice are always visible for a user in the vessel.

The pneumatic actuator may comprise a first end attached to the main body portion, and an opposite second end attached to the toss-arm wherein the pneumatic actuator is configured to perform a reciprocating movement to move said toss-arm about the pivot axis.

Accordingly, the pneumatic actuator may have its first end fixed to the main body portion, wherein the opposite end reciprocates to move the toss-arm about the pivot axis which allows for a more rigid structure.

The pneumatic actuator may be configured to, upon actuation, move the toss-arm about the pivot axis with one degree of freedom with an amplitude of maximum 90 degrees, preferably with an amplitude in the range of 15-60 degrees.

Thus, the pneumatic actuator may be arranged to swing the toss-arm about the pivot axis in the manner of a pendulum. Thus, the amplitude is defined as the degrees that the pendulum can be made to swing from the normal state which is when the toss-arm is vertical.

The control circuit may be configured to control the pneumatic actuator so to reciprocate the toss-arm about the pivot axis a plurality of times with a quivering force prior to moving the toss-arm with said ejection force, wherein the ejection force is greater than the quivering force, wherein the quivering force allows the at least one die to be held in the vessel while reciprocated. Thus, the quivering force is a magnitude of force that allows the dice to be held in the vessel.

A benefit of this is that it results in to even further randomizing the initial conditions of the dice toss of the automated dice tossing apparatus. By reciprocating the toss-arm about the pivot axis with a quivering force, the dice are shaken in the vessel but not tossed away from the vessel. The quivering force allow the dice to be shaken to even further randomize the initial conditions of the throw. Also, this even further resembles a human dice toss by shaking the dice in the vessel prior to moving the toss-arm with the ejection force that tosses the dice. The vessel is arranged so that it holds dice loose and the quivering force forces dice into spinning motion.

The pneumatic actuator may further comprise a micro mist separator which allows the pneumatic actuator to be kept clean such that it is more robust and have a longer life-time.

The pneumatic actuator may comprise a pneumatic muffler. This is beneficial to have since it allows the pneumatic actuator to be quiet when actuated. Further being unnoticed by users during a game or gambling session.

The proximal portion of said toss-arm may comprise a shock-absorber. This allows for the toss-arm to have a less chance of being broken since the shock-absorber prevents damaging movements of the toss arm, especially when being under the ejection force.

The vessel comprises a bottom wall, two opposite side walls and a back wall in-between the side walls, forming an enclosure open at a first end and closed at the opposite second end.

Further, the two opposite side walls comprise a tapered extension from the second end to the first end, forming a shovel-like structure. This structure is beneficial since it allows the dice to be tossed from the first end of the vessel. Further, the direction of the toss of the dice is further controlled by the two opposite side-walls.

The automated dice tossing apparatus may further comprise a sensor for determining the presence of dice in the vessel, wherein the control circuitry is configured to determine when the at least one die is tossed away from the vessel, based on sensor data obtained from the sensor.

The sensor will determine when the dice is not further present in the vessel. Further, the control circuitry may reset the pneumatic cylinder to a resting state when the dice has been tossed from the vessel.

The vessel may be arranged to hold two dice, wherein the control circuitry is configured to adapt the ejection force such that a single die is tossed from the vessel at a time. Accordingly, the toss-arm reciprocates twice with said ejection force. A benefit of this is that it allows for the possibility to enhance the user experience by tossing a die at a time.

The vessel may be arranged to hold two dice, wherein the control circuitry is configured to adapt the ejection force such that the at least one die tossed from the vessel lands at a predetermined distance away from the vessel.

The predetermined distance may be within a range, such that the dice lands at a playing surface.

The automated dice tossing apparatus may further comprise a flat surface arranged as a landing area for said at least one die, the flat surface including indicia thereon. The indicia included on the flat surface may be indicia that correspond to a specific game such as craps. The flat surface may be a playing surface for a game.

The control circuitry of the automated dice tossing apparatus may be configured to control the pneumatic actuator, over a communications network.

The control circuitry may be configured to actuate the pneumatic actuator based on a command from a user equipment, UE, over a communications network. Thus, a user may actuate the dice tossing apparatus over a UE. The automated dice tossing apparatus based on this may be implemented in a game streaming service such that viewers of the service can participate in the game.

The automated dice tossing apparatus may be configured to report the state of the automated dice tossing apparatus to the control circuitry.

The control circuitry may be remote from the automated dice tossing apparatus, wherein the dice tossing apparatus comprises an interface to obtain signals from the control circuitry.

There is further provided a method for operating an automated dice tossing apparatus, comprising; a main body portion; an elongated toss-arm, having a proximal portion rotatably attached to said main body about a pivot axis, a vessel mounted to a distal portion of said toss-arm holding at least one die and a pneumatic actuator.

The method comprises the steps of randomly determining a magnitude of the ejection force within a predefined range in order to randomize a set of initial conditions for the actuation of the pneumatic actuator; actuating said pneumatic actuator with an ejection force to move the toss-arm about the pivot axis such that at least one die held in the vessel is tossed away from said vessel towards a predefined target area.

The method may further comprise the step of preceding the step of actuating said pneumatic actuator with an ejection force; actuating said pneumatic actuator with a quivering force to reciprocate the toss-arm about the pivot axis, wherein said ejection force is greater than said quivering force.

DETAILED DESCRIPTION

In the following detailed description, some embodiments of the present disclosure will be described. However, it is to be understood that features of the different embodiments are exchangeable between the embodiments and may be combined in different ways, unless anything else is specifically indicated. Even though in the following description, numerous specific details are set forth to provide a more thorough understanding of the provided automated dice tossing apparatus, and method for operating the same, it will be apparent to one skilled in the art that the disclosure may be realized without these details. In other instances, well known constructions or functions are not described in detail, so as not to obscure the present disclosure. The disclosure is not limited by the embodiments described but can be modified in various ways within the scope of the claims.

Figure 1:
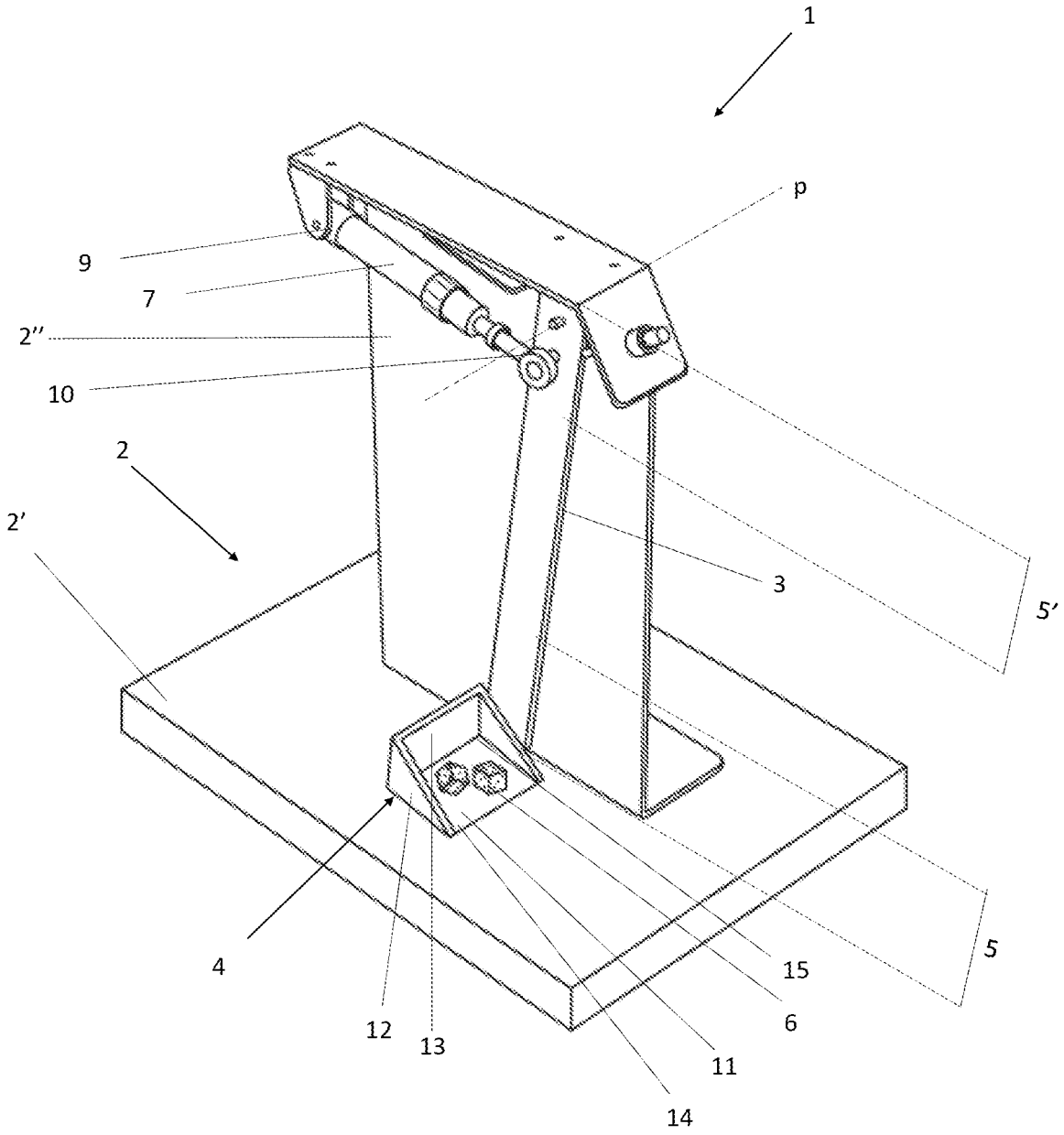
FIG. 1 depicts a perspective view of an automated dice tossing apparatus viewed from the front.

FIG. 1 shows a perspective view of an automated dice tossing apparatus 1 viewed from the front. The automated dice tossing apparatus 1 comprises a main body portion 2; an elongated toss-arm 3, having an proximal portion 5' rotatably attached to said main body 2 about a pivot axis p, a vessel 4 mounted to a distal portion 5 of said toss-arm 3 for holding at least one die 6; a pneumatic actuator 7 configured to, upon actuation, move the toss-arm 3 about the pivot axis p with an ejection force such that at least one die held 6 in the vessel 4 is tossed away from said vessel 4 (see FIG. 7) towards a predefined target area; and control circuitry 8 (not shown in FIG. 1) configured to randomly determine a magnitude of the ejection force within a predefined range in order to randomize a set of initial conditions for each actuation of the pneumatic actuator 7.

As shown in FIG. 1, the main body portion 2 of the automated dice tossing apparatus 1 comprises a bottom surface 2' and a vertically extending frame 2". As seen in FIG. 1, the proximal portion 5' of the toss arm 3 is rotatably attached to the frame 2".

FIG. 1 further shows that there are two dice 6 held in the vessel 4. As shown, the two dice 6 are held loosely in the vessel 4.

FIG. 1 further shows that the pneumatic actuator 7 comprises a first end 9 attached to the main body portion 2, and an opposite second end 10 attached to the toss-arm 3, wherein the pneumatic actuator 7 is configured to perform a reciprocating movement to move said toss-arm 3 about the pivot axis p. Accordingly, in FIGS. 1-5, the first end 9 of the pneumatic actuator 7 is fixed, wherein the second end 10 reciprocates. The pneumatic actuator is in FIG. 1 a cylinder formed pneumatic actuator 7.

Figure 2:
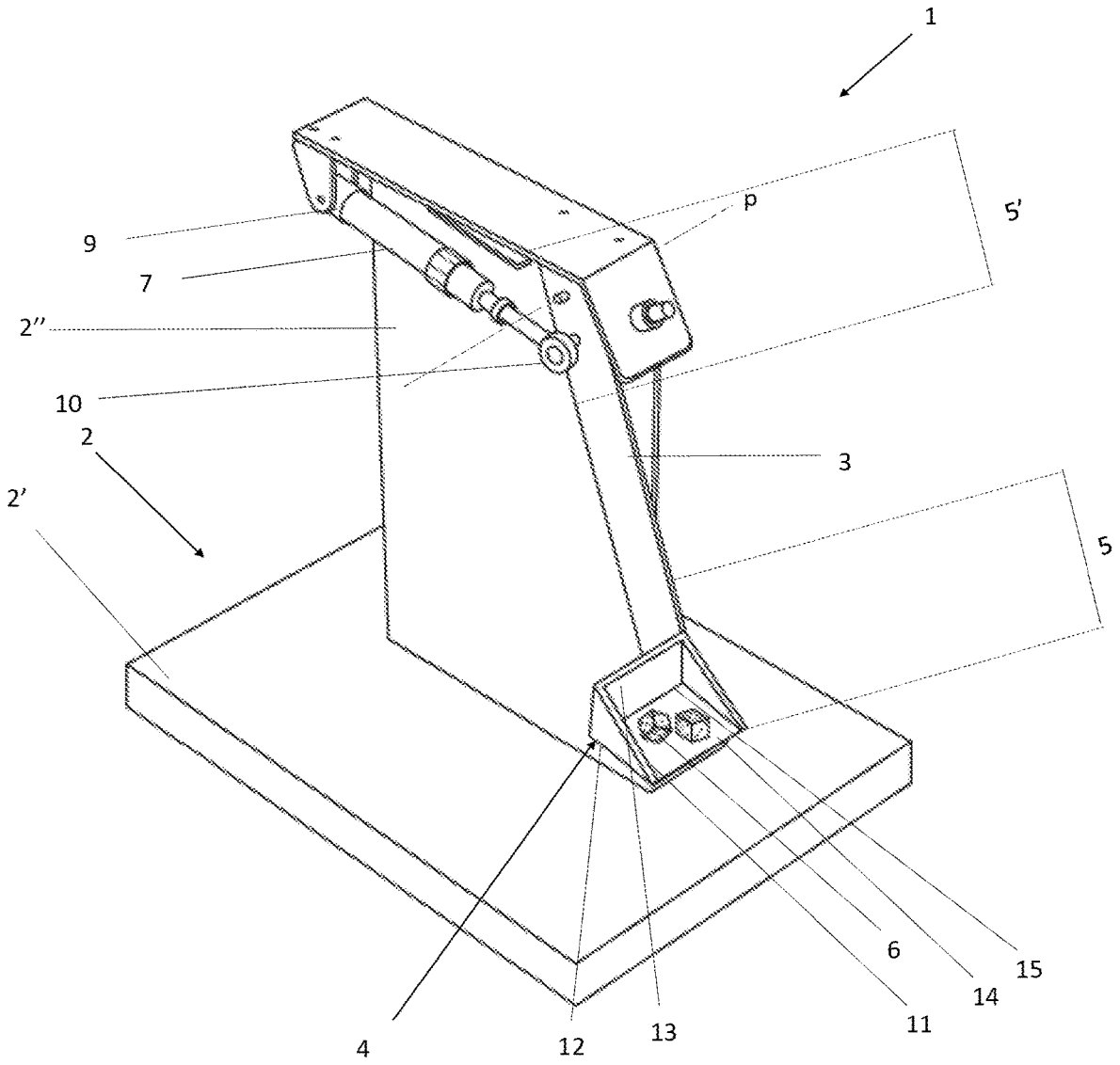
FIG. 2 depicts a perspective view of an automated dice tossing apparatus viewed from the front.

FIG. 2 shows a perspective view of an automated dice tossing apparatus 1 viewed from the front. The difference between the FIGS. 1 and 2 is that the toss-arm 3 is positioned differently in the Figures. In FIG. 2, the pneumatic actuator 7 has pushed the toss-arm 3 forward compared to FIG. 1. Thus, FIG. 2 may illustrate the vessel 4 holding the dice 6 preceding the dice 6 are tossed away from the vessel 4. In FIG. 2, the pneumatic actuator 7 is extended compared to the pneumatic actuator 7 in FIG. 1. The pneumatic actuator 7 may reciprocate the toss arm 3 by extending and shortening movements of the pneumatic actuator 7.

As shown in the FIGS. 1 and 2, the vessel 4 comprises a bottom wall 11, two opposite side walls 12 and a back wall 13 in-between the side walls 12, forming an enclosure open at a first end 14 and closed at the opposite second end 15. Further, the FIGS. 1 and 2 shows that the two opposite side walls 12 comprise a tapered extension from the second end 15 to the first end 14, forming a shovel-like structure. The tapered extension may be seen to resemble a triangle that extends from the first end 14 to the second end 15, being perpendicular to the bottom wall 11.

The FIGS. 1-6 show that the pneumatic actuator 7 is configured to, upon actuation, move the toss-arm 3 about the pivot axis p with one degree of freedom with an amplitude of maximum 90 degrees, preferably 15-60 degrees.

Figure 3:
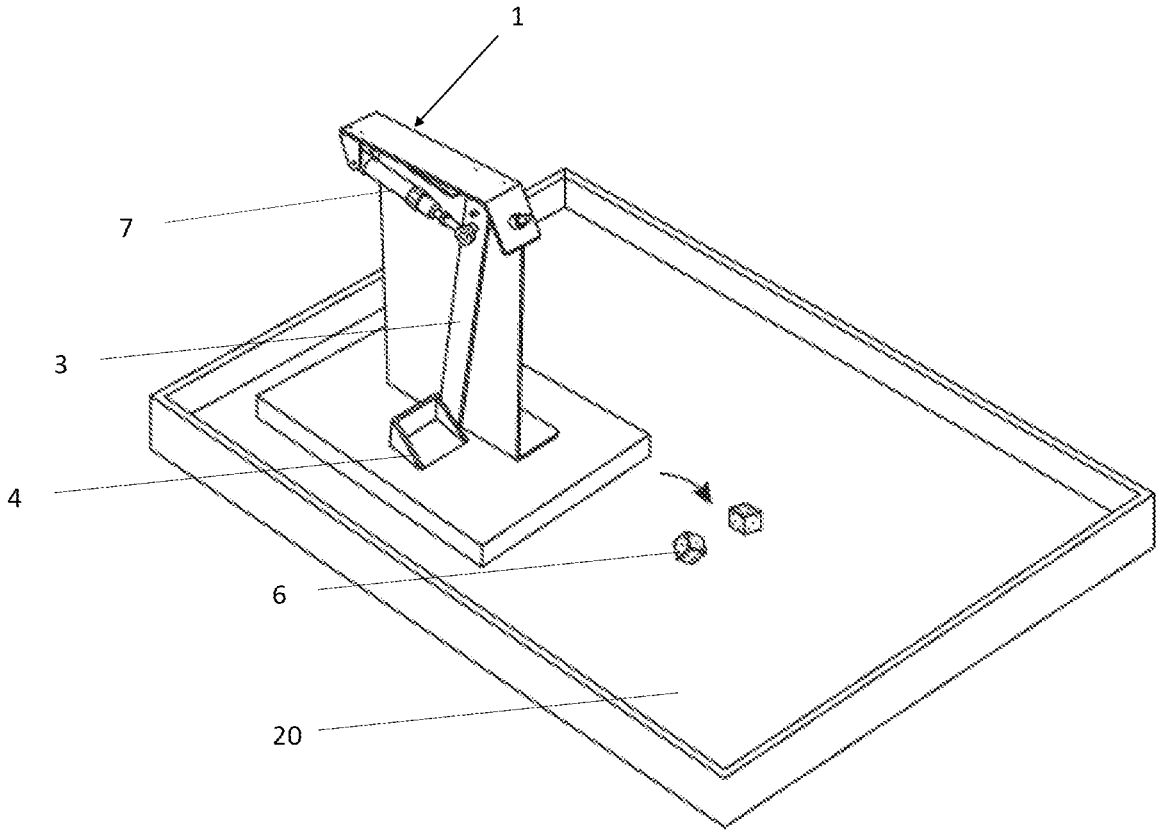
FIG. 3 depicts a perspective view of an automated dice tossing apparatus viewed from the front following the toss of two dice.

FIG. 3 discloses the automated dice tossing apparatus 1 when two dice 6 are tossed away from the vessel 4. Accordingly, FIG. 3 discloses the automated dice tossing apparatus 1 following that the pneumatic actuator 7 has moved the toss arm 3 about the pivot axis p with an ejection force.

Figure 4:
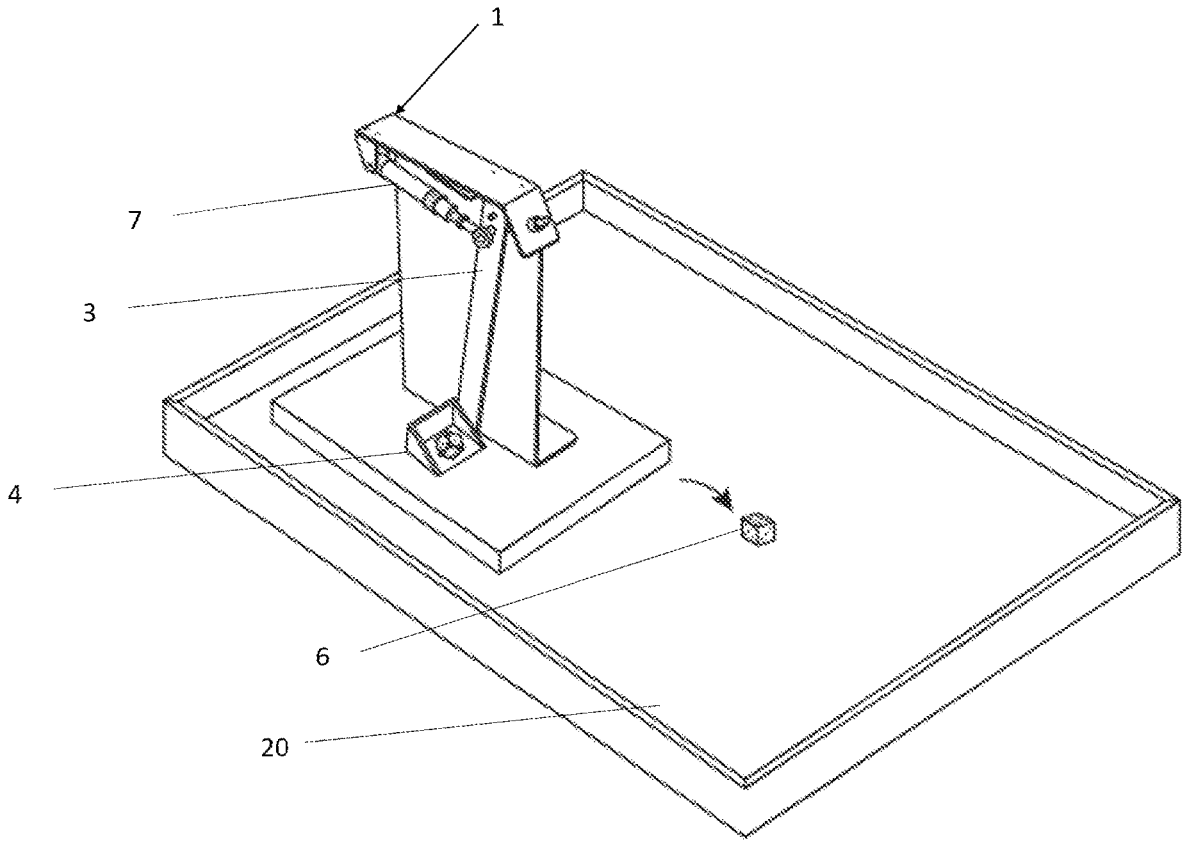
FIG. 4 depicts a perspective view of an automated dice tossing apparatus viewed from the front following the toss of one die.

In FIG. 4 there is shown a perspective view of an automated dice tossing apparatus 1 viewed from the front following the toss of a die 6. However, a die 6 is still held in the vessel 4. Accordingly, the control circuitry 8 in the apparatus in FIG. 4 is configured to adapt the ejection force such that a single die 6 is tossed from the vessel 4 at a time.

In the FIGS. 3 and 4, the dice 6 are tossed away from the first end 14 of the vessel 4. In the FIGS. 4 and 5, the automated dice tossing apparatus 1 comprises a flat surface 20 arranged as a landing area for said at least one die, the flat surface 20 may include indicia thereon. The indicia included on the flat surface 20 may be indicia that correspond to a specific game such as craps.

The vessel 4 in FIGS. 3 and 4 is arranged to hold two dice 6, wherein the control circuitry 8 is configured to adapt the ejection force such that the at least one die 6 tossed from the vessel 4 lands at a predetermined distance away from the vessel 4. Thus, the control circuitry 8 may adapt the ejection force such that the dice 6 preferably land on the flat surface 20, more preferably at an end of the flat surface 20.

Figure 5:
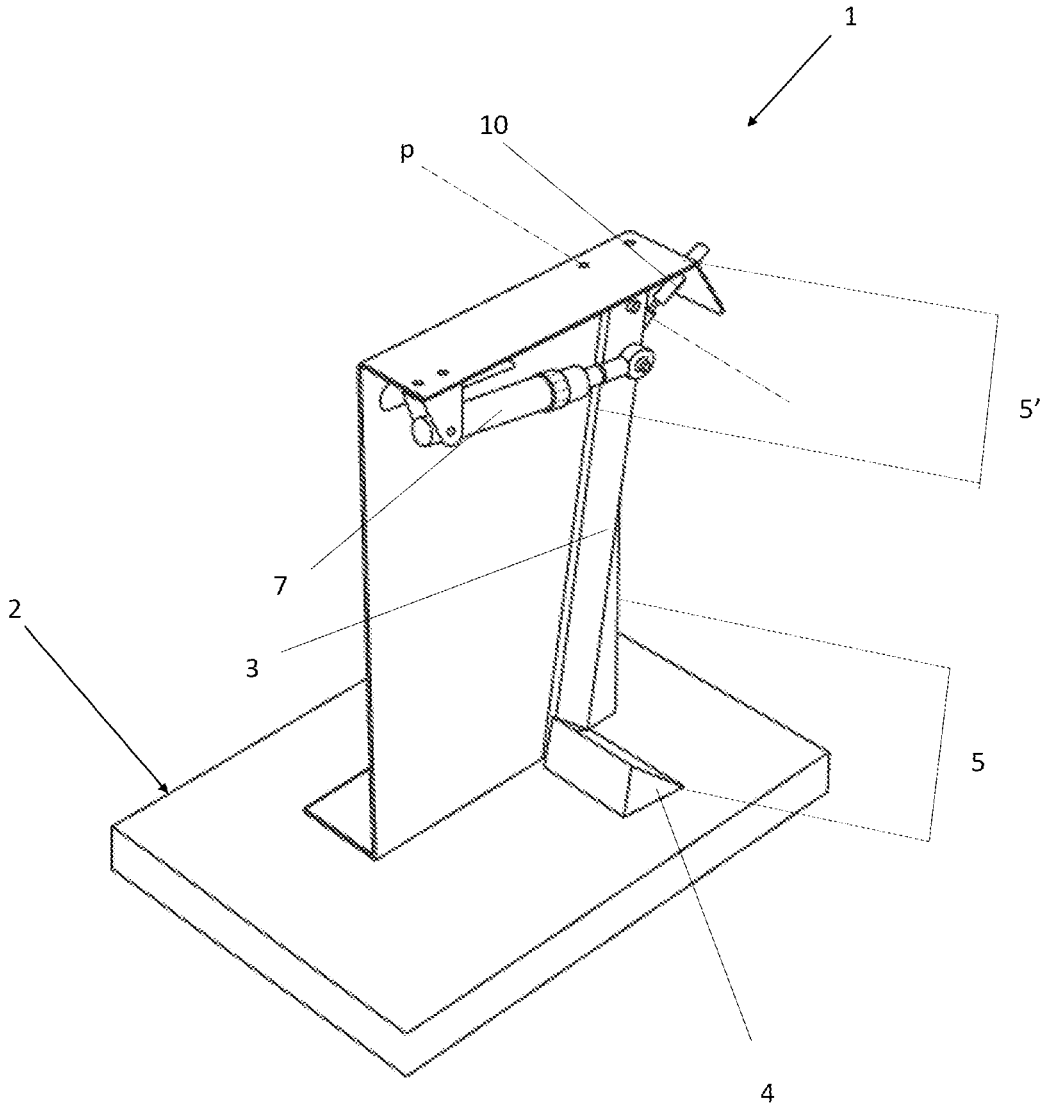
FIG. 5 depicts a perspective view of an automated dice tossing apparatus viewed from the back.

FIG. 5 shows a perspective view of an automated dice tossing apparatus viewed from the back. In FIG. 5, the proximal portion 5' of said toss-arm 3 comprises a shock-absorber 10. One end of the shock absorber 10 is fixed to the main body portion 2 and one opposite end of the shock-absorber 10 is fixed to the toss-arm 3. Further, the pneumatic actuator 7 may comprise a micro mist separator and/or a pneumatic muffler. Accordingly, the shock-absorber 10 in FIG. 5 prevents the pneumatic actuator 7 and the toss-arm 3 to take any damage when the pneumatic actuator 7 moves the toss-arm 3 about the pivot axis p.

Figure 6:
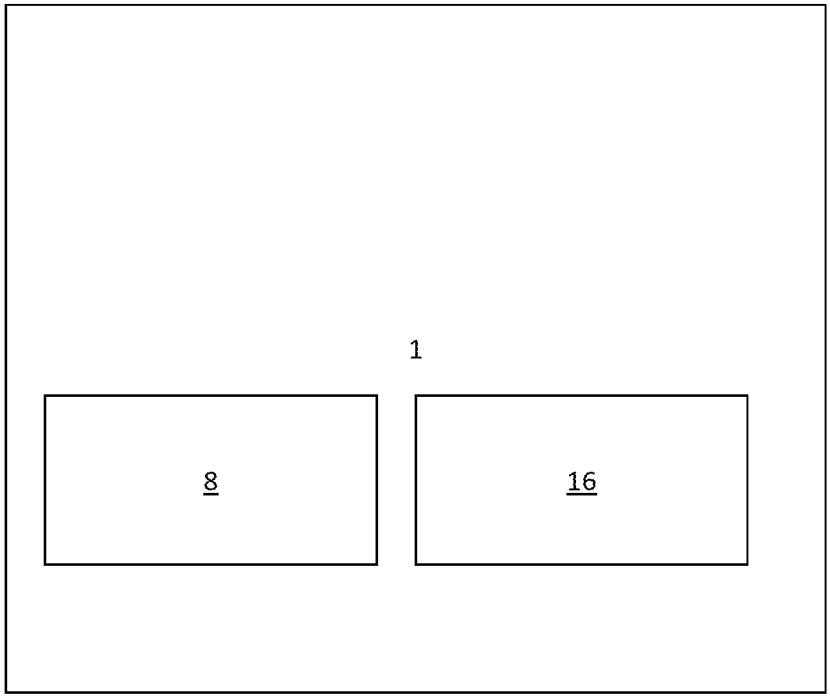
FIG. 6 schematically depicts a dice tossing apparatus.

FIG. 6 schematically illustrates the dice tossing apparatus 1 comprising the control circuitry 8 and a sensor 16 for determining the presence of dice 6 in the vessel 4, wherein the control circuitry 8 is configured to determine when the at least one die 6 is tossed away from the vessel 4, based on sensor data obtained from the sensor 16.

Figure 8:
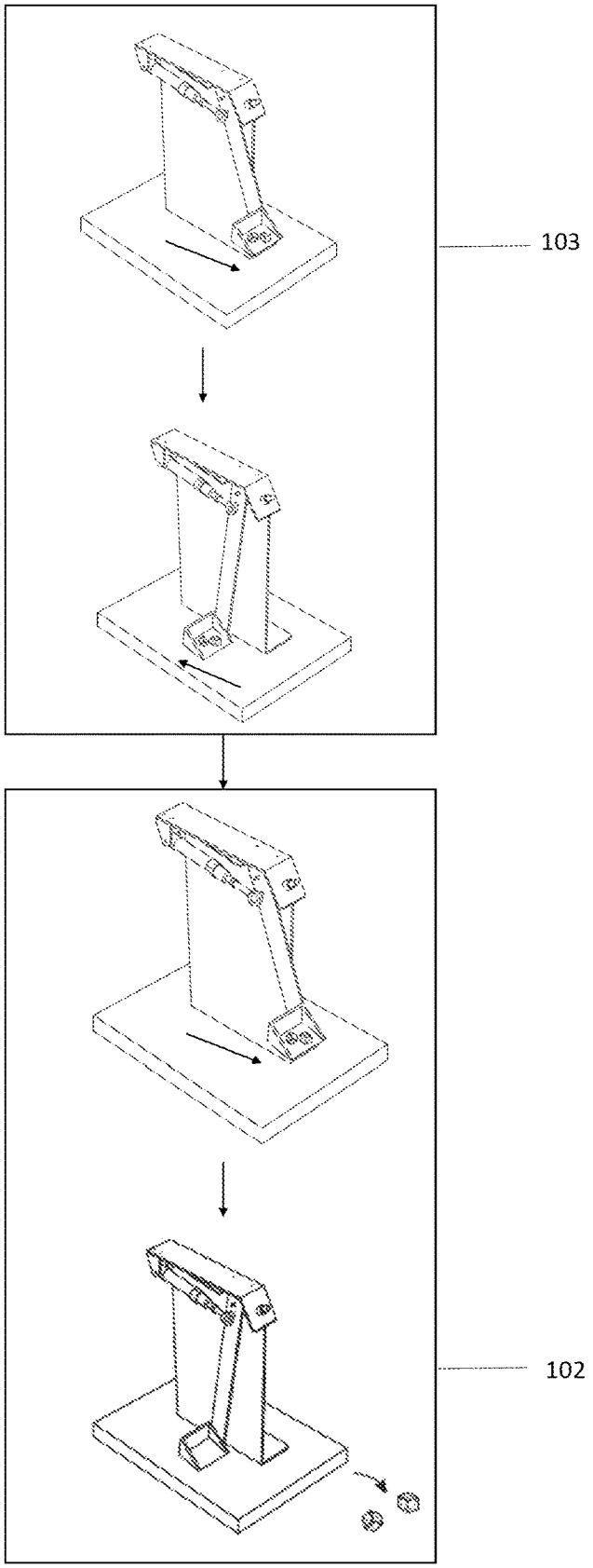
FIG. 8 depicts a part of the method for operating a dice tossing apparatus shown in FIG. 7, showing the additional step of actuating the pneumatic actuator with a quivering force preceding actuating the pneumatic actuator with an ejection force.

The control circuit 8 may be configured to control the pneumatic actuator 7 so to reciprocate the toss-arm 3 about the pivot axis p a plurality of times with a quivering force prior to moving the toss-arm 3 with said ejection force, wherein the ejection force is greater than the quivering force, wherein the quivering force allows the at least one die 6 to be held in the vessel 4 while reciprocated (see e.g. FIG. 8). This allows the dice 6 to be shaken/shuffled without being tossed away from the vessel 4.

Figure 7:
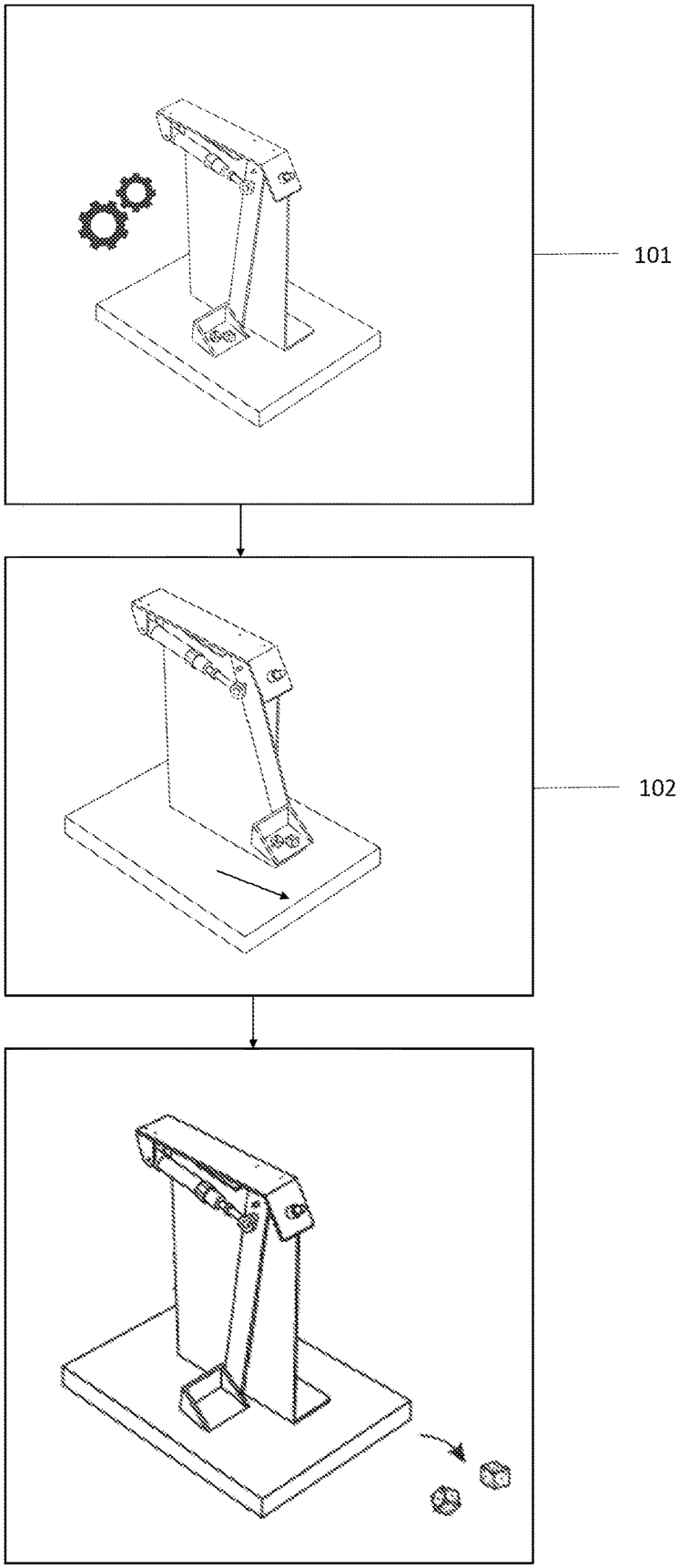
FIG. 7 depicts a method for operating a dice tossing apparatus.

FIG. 7 shows a method 100 for operating an automated dice tossing apparatus 1, comprising; a main body portion 2; an elongated toss-arm 3, having a proximal portion 5' rotatably attached to said main body 2 about a pivot axis p, a vessel 4 mounted to a distal portion 5 of said toss-arm 4 holding at least one die 6 and a pneumatic actuator 7. The method 100 comprising the steps of; randomly determining a magnitude of the ejection force within a predefined range in order to randomize a set of initial conditions for the actuation of the pneumatic actuator 7; actuating said pneumatic actuator 7 with an ejection force to move the toss-arm 3 about the pivot axis p such that at least one die 6 held in the vessel 4 is tossed away from said vessel 4 towards a predefined target area.

FIG. 8 shows the method in FIG. 7 further comprising; preceding the step of actuating said pneumatic actuator 7 with an ejection force; actuating said pneumatic actuator 7 with a quivering force to reciprocate the toss-arm 3 about the pivot axis p, wherein said ejection force is greater than said quivering force. The toss-arm 3 may reciprocate a plurality of times, preferably 1-30 reciprocating motions.

In FIG. 7, the apparatus moves the toss-arm 3 with the quivering force, holding the dice 6 in the vessel 4. Following with the step of moving the toss-arm 3 with an ejection force such that the dice 3 are tossed away from the vessel 4.

Figure 9:
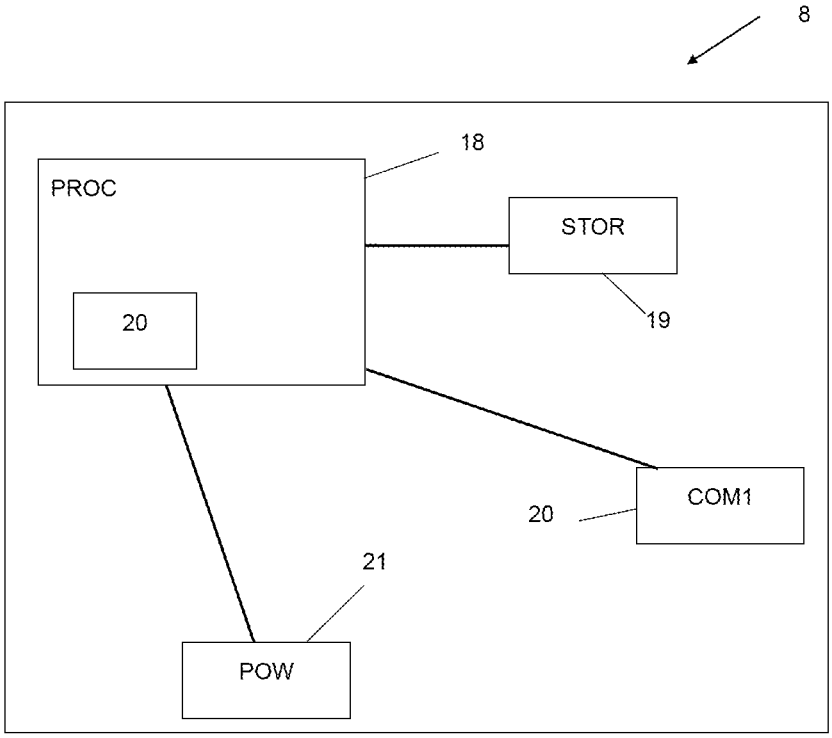
FIG. 9 schematically depicts control circuitry of the automated dice tossing apparatus.

As seen in FIG. 9, the control circuitry 8 may comprise a processing device 18 arranged to run computer implemented instruction sets, stored on a computer readable storage medium 19, for controlling the operation of the dice tossing apparatus. The processing device may be arranged to determine a random number using a digital or an analogue random number generator (RNG) unit 20 configured to provide a random number within a specific range to provide the dice tossing apparatus 1 with a control signal controlling the ejection magnitude with the ejection force needed to toss the at least one die. The processing device 18 may comprise a microprocessor, an application specific integrated circuit (ASIC), a field programmable gate array (FPGA), a digital signal processor (DSP), central processing unit (CPA), graphics processing unit (GPU), or similar processing devices. The processing device 18 may be configured to actuate the pneumatic actuator 7, based on the ejection force (and quivering force) determined by the RNG unit 20. The computer readable storage medium 19 may comprise volatile or non-volatile memory, such as for instance random access memory (RAM) of any type, a hard disk, a solid-state disk, a flash drive, an optical disc, or similar storage media for storing software code or instruction sets for operating the apparatus and methods of operation. The control circuitry 8 may alternatively comprise analogue electronics for providing a random or semi-random control signal for controlling the ejection magnitude.

The control circuitry 8 may be configured to provide a communication interface 20 to communicate over network. Network may encompass wired and/or wireless networks such as a local-area network (LAN), a wide-area network (WAN), a computer network, a wireless network, a telecommunications network, another like network or any combination thereof.

The automated dice tossing apparatus 1 as disclosed herein may further comprise power circuitry 21. Power circuitry 21 may comprise, or be coupled to, power management circuitry and is configured to perform the functionality described herein. Power circuitry 21 may receive power from power source. Power source may either be included in, or external to, power circuitry 21. Further, power source may comprise a source of power in the form of a battery or battery pack which is connected to, or integrated in, power circuitry. The battery may provide backup power should the external power source fail. Other types of power sources, such as photovoltaic devices or super capacitors may also be used.

The present disclosure may further provide control circuitry 8 for controlling the dice tossing apparatus 1 as disclosed herein.

It should be noted that the word "comprising" does not exclude the presence of other elements or steps than those listed and the words "a" or "an" preceding an element do not exclude the presence of a plurality of such elements. It should further be noted that any reference signs do not limit the scope of the claims, that the disclosure may be at least in part implemented by means of both hardware and software, and that several "means" or "units" may be represented by the same item of hardware.

Although the figures may show a specific order of method steps, the order of the steps may differ from what is depicted. In addition, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps. The above mentioned and described embodiments are only given as examples and should not be limiting to the present disclosure. Other solutions, uses, objectives, and functions within the scope of the disclosure as claimed in the below described patent embodiments should be apparent for the person skilled in the art.

The invention claimed is:

1. An automated dice tossing apparatus comprising;

a main body portion;

an elongated toss-arm, having a proximal portion rotatably attached to said main body portion about a pivot axis, a vessel mounted to a distal portion of said toss-arm for holding at least one die;

a pneumatic actuator configured to, upon actuation, move the toss-arm about the pivot axis with an ejection force such that at least one die held in the vessel is tossed away from said vessel towards a predefined target area; and control circuitry configured to randomly determine a magnitude of the ejection force within a predefined range in order to randomize a set of initial conditions for each actuation of the pneumatic actuator.

2. The automated dice tossing apparatus according to claim 1, wherein the pneumatic actuator comprises a first end attached to the main body portion, and an opposite second end attached to the toss-arm wherein the pneumatic actuator is configured to perform a reciprocating movement to move said toss-arm about the pivot axis.

3. The automated dice tossing apparatus according to claim 1, wherein the pneumatic actuator is configured to, upon actuation, move the toss-arm about the pivot axis with one degree of freedom with an amplitude of maximum 90 degrees.

4. The automated dice tossing apparatus according to claim 1, wherein the control circuitry is configured to control the pneumatic actuator so to reciprocate the toss-arm about the pivot axis a plurality of times with a quivering force prior to moving the toss-arm with said ejection force, wherein the ejection force is greater than the quivering force, wherein the quivering force allows the at least one die to be held in the vessel while reciprocated.

5. The automated dice tossing apparatus according to claim 1, wherein the pneumatic actuator comprises a micro mist separator.

6. The automated dice tossing apparatus according to claim 1, wherein the pneumatic actuator comprises a pneumatic muffler.

7. The automated dice tossing apparatus according to claim 1, wherein the proximal portion of said toss-arm comprises a shock-absorber.

8. The automated dice tossing apparatus according to claim 1, wherein the vessel comprises a bottom wall, two opposite side walls and a back wall in-between the side walls, forming an enclosure open at a first end and closed at the opposite second end.

9. The automated dice tossing apparatus according to claim 8, wherein the two opposite side walls comprise a tapered extension from the second end to the first end, forming a shovel-like structure.

10. The automated dice tossing apparatus according to claim 1, wherein the automated dice tossing apparatus further comprises a sensor for determining the presence of dice in the vessel, wherein the control circuitry is configured to determine when the at least one die is tossed away from the vessel, based on sensor data obtained from the sensor.

11. The automated dice tossing apparatus according to claim 1, wherein the vessel is arranged to hold two dice, wherein the control circuitry is configured to adapt the ejection force such that a single die is tossed from the vessel at a time.

12. The automated dice tossing apparatus according to claim 1, wherein the vessel is arranged to hold two dice, wherein the control circuitry is configured to adapt the ejection force such that the at least one die tossed from the vessel lands at a predetermined distance away from the vessel.

13. A method for operating an automated dice tossing apparatus, comprising; a main body portion; an elongated toss-arm, having a proximal portion rotatably attached to said main body portion about a pivot axis, a vessel mounted to a distal portion of said toss-arm holding at least one die and a pneumatic actuator; the method comprising the steps of;

randomly determining a magnitude of the ejection force within a predefined range in order to randomize a set of initial conditions for the actuation of the pneumatic actuator;

actuating said pneumatic actuator with an ejection force to move the toss-arm about the pivot axis such that at least one die held in the vessel is tossed away from said vessel towards a predefined target area.

14. The method according to claim 13, further comprising; preceding the step of actuating said pneumatic actuator with an ejection force;

actuating said pneumatic actuator with a quivering force to reciprocate the toss-arm about the pivot axis, wherein said ejection force is greater than said quivering force.

* * * * *